US008308090B2

(12) United States Patent
Watts

(10) Patent No.: US 8,308,090 B2
(45) **Date of Patent: *Nov. 13, 2012**

(54) GRINDER

(75) Inventor: Kyle T. Watts, Lee's Summit, MO (US)

(73) Assignee: Energy Creates Energy, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/111,353

(22) Filed: May 19, 2011

(65) Prior Publication Data

US 2011/0215179 A1 Sep. 8, 2011

Related U.S. Application Data

(63) Continuation of application No. 12/493,470, filed on Jun. 29, 2009, now Pat. No. 7,950,601.

(51) Int. Cl.
*B02C 19/00* (2006.01)

(52) U.S. Cl. ..... 241/55; 241/275

(58) Field of Classification Search ..... 241/55, 241/56, 188.1, 275
See application file for complete search history.

(56) References Cited

U.S. PATENT DOCUMENTS 7,950,601 B2 * 5/2011 Watts ..... 241/55

* cited by examiner

*Primary Examiner* — Mark Rosenbaum
(74) *Attorney, Agent, or Firm* — Brinks Hofer Gilson & Lione

(57) ABSTRACT

A grinder includes a generally vertical, rotatable shaft having at least one set of cutter blades driven thereby and a fan assembly mounted on the shaft below the cutter blades in position to receive output therefrom. The fan assembly includes a fan disc secured to the shaft and rotatable therewith. Fan blades are secured to the fan disc in a generally radial orientation. Each fan blade includes a bottom flange secured to a top surface of the fan disc, a web extending upwardly from the bottom flange and a top flange extending outwardly from the web in a direction of rotation of the fan disc. The fan blades are preferably moveably mounted to the fan disc such that the angle of the fan blades relative to a true radial orientation can be adjusted.

8 Claims, 10 Drawing Sheets

GRINDER

CROSS REFERENCE TO RELATED APPLICATION

This application is a continuation of U.S. Nonprovisional patent application Ser. No. 12/493,470 filed Jun. 29, 2009 (now U.S. Pat. No. 7,950,601), which is hereby incorporated by reference in its entirety.

FIELD OF THE INVENTION

The present invention relates to grinders, mills or shredders used to convert a material from an unprocessed state to a processed state having a reduced particle size.

BACKGROUND OF THE INVENTION

Grinders, shredders or mills are well known devices for reducing the particle size of a material. For example, U.S. Pat. No. 5,192,029 to Harris and U.S. Pat. No. 5,680,994 to Eide et al. each disclose mills for grinding garbage. Each of these mills includes a rotor rotatably mounted in a generally octagonal housing. The rotor includes a generally vertical shaft and a plurality of blades or hammers mounted on the shaft. Garbage is admitted into the housing through an inlet near the top of the housing and is impacted by the blades of the rotor. Material of a reduced particle size is removed from the mill through an outlet near the bottom of the housing. The ground garbage can be sent to a landfill where it will take up less room than unprocessed garbage, or it can be composted or recycled, depending on the included materials. If the material is to be shipped, it can be shipped more efficiently due to its reduced size and greater density.

The mill of Eide et al. '994 further includes a fan or impeller which is mounted on the rotor shaft below the cutting blades. The fan is intended to create airflow which acts to move material through the mill and to expel it from the outlet. The fan generally comprises a fan disc mounted to the rotor shaft which has a plurality of radially extending lengths of angle iron mounted thereon. One flange of each angle iron is bolted to the fan disc and the other extends upwardly from the disc to act as a fan blade. The angle irons are fixedly mounted to the fan disc and no means are provided for adjusting the airflow for different materials or grinding conditions.

It should be noted that, in addition to moving material through the mill, the airflow from the fan also acts to remove moisture from the material as it is being ground. Since different materials and different grinding conditions produce different moisture levels in the material, it would be advantageous if the rate of airflow could be adjusted.

SUMMARY OF THE INVENTION

The present invention is a grinder of the general type disclosed above and including an improved fan assembly. The fan assembly includes fan blades having an additional top flange which extends generally in the direction of rotation of the fan disc. The top flanges increase efficiency by inhibiting air from flowing over the tops of the fan blades and thereby drawing more air through the system. The fan blades are adjustably mounted to the fan disc so that they can be repositioned for increasing or decreasing airflow through the grinder.

DETAILED DESCRIPTION OF PREFERRED EMBODIMENTS

Figure 1:
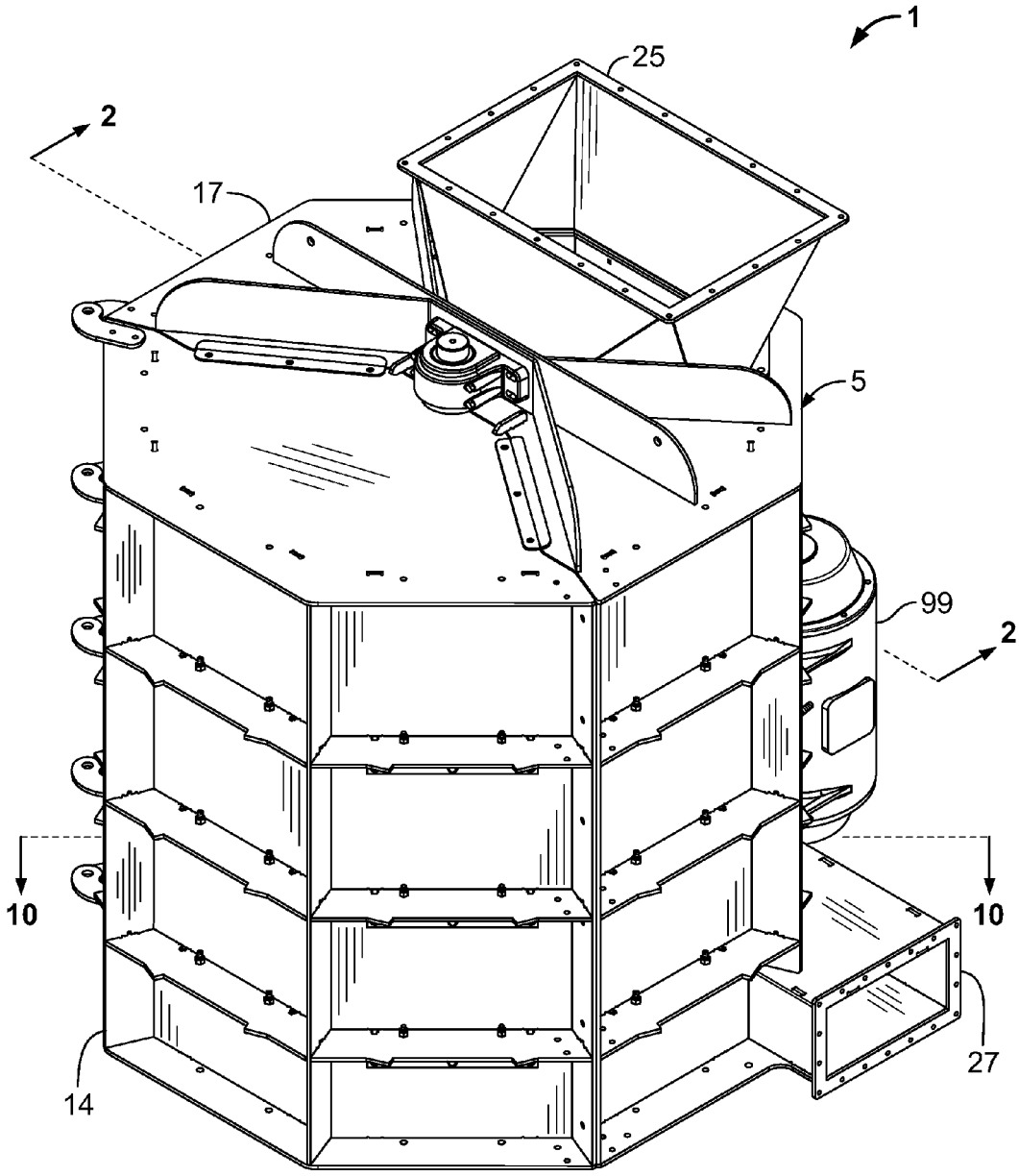
FIG. 1 is a perspective view of a grinder according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a grinder according to the present invention. The grinder 1 includes a rotor 3 rotatably mounted in a housing 5. The rotor 3 includes a generally vertical shaft 7 and a plurality of cutter discs 9 longitudinally mounted on the shaft 7 and extending radially outward therefrom. A fan disc 10 is connected to the shaft 7 below the lowermost of the cutter discs 9 and spaced downwardly therefrom. For example, the drawings show three cutter discs 9 denominated as discs 9*a*, 9*b*, and 9*c* from top to bottom, with the fan disc 10 spaced downwardly from cutter disc 9*c*.

Each cutter disc 9 has a plurality of cutter blades or hammers 11 connected thereto which extend radially outward past the outer edge of the respective cutter disc 9. Four hammers 11 arranged at 90 degree intervals are shown for each of the cutter discs 9. The hammers 11 are each shown as being rigidly connected to the top surface of the respective cutter disc 9 by a pair of bolts 13. It is foreseen, however, that each hammer 11 could be fastened by only a single bolt 13 so as to pivot or swing about the bolt 13 relative to the respective cutter disc 9.

The housing 5 is generally octagonal in shape and includes a sidewall 14 comprising eight sidewall sections 15, a top wall 17 and a bottom wall 19. The housing 5 includes a door 21, comprising three of the sidewall sections 15, which is hingedly connected to a main housing 23 which comprises the remaining five sidewall sections 15. The top and bottom walls 17 and 19 are each divided into respective first sections 17*a* and 19*a* which form part of the main housing 23 and respective second sections 17*b* and 19*b* which form part of the door 21. The line of division between the first sections 17*a* and 19*a* and the second sections 17*b* and 19*b* preferably extends through the axis of rotation of the shaft 7 such that the rotor 3 may be easily installed or removed through the opening provided by swinging open the door 21. An entrance chute 25 for admitting material into the grinder 1 is formed on the top wall 17 and communicates with the interior of the housing 5 through an opening in the top wall 17. A discharge chute 27 for discharging material from the grinder 1 is formed through the sidewall 14 and communicates with the interior of the housing 5 through an opening formed in the sidewall 14 just above the plane of rotation of the fan disc 10.

The shaft 7 of the rotor 3 is rotatably journaled to the main housing section 23 by upper and lower bearings 29 and 31 respectively. The upper bearing 29 is mounted in a pillow block 32 located immediately above the top wall 17 and connected to an upper framework 33 which is fixed to the top wall 17. Similarly, the lower bearing 31 is mounted in a pillow block 34 located immediately below the bottom wall 19 and connected to a lower framework 35 which is fixed to the bottom wall 19.

Figure 3:
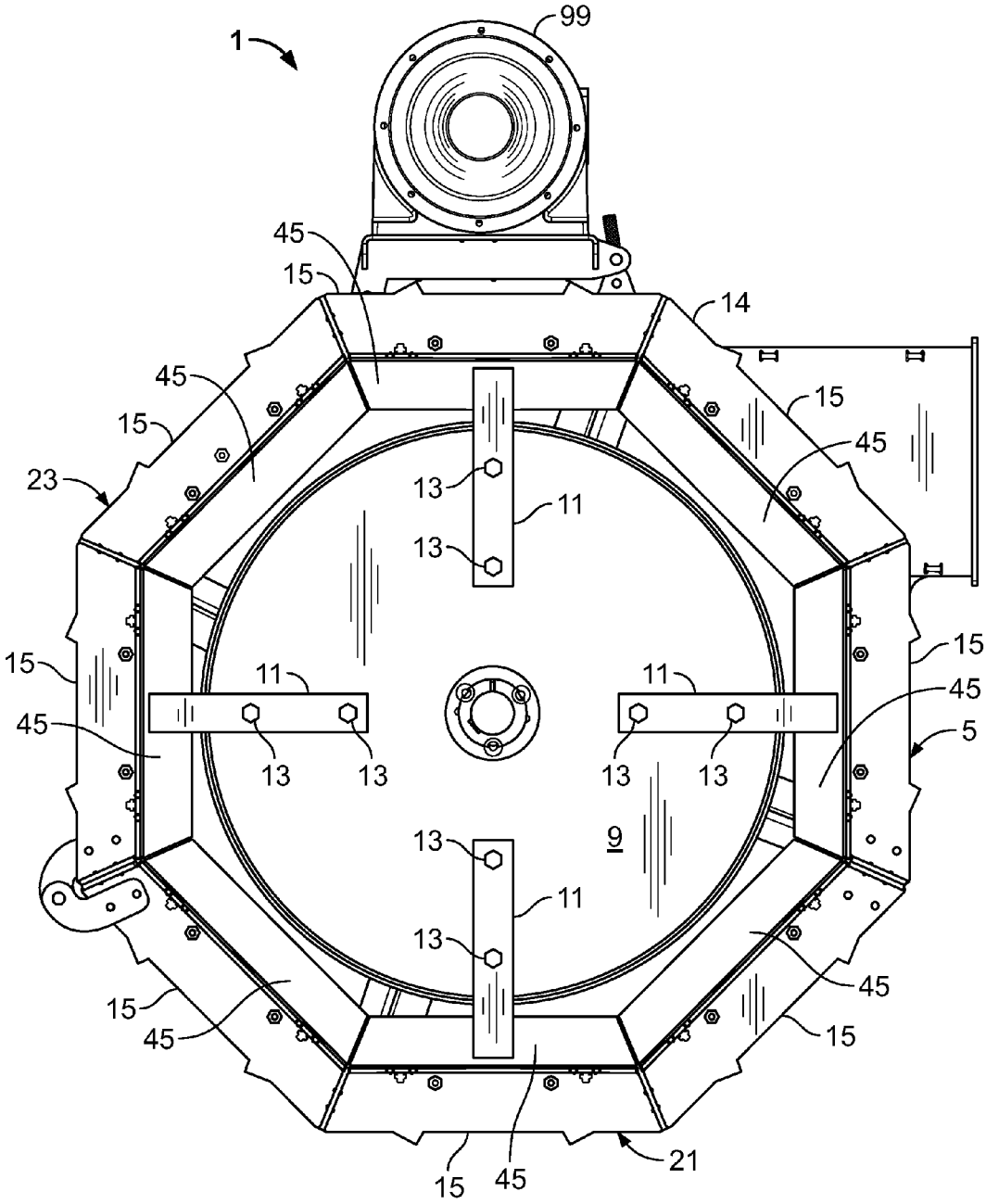
FIG. 3 is a cross sectional view of the grinder taken generally along line 3-3 in FIG. 2.
Figure 4:
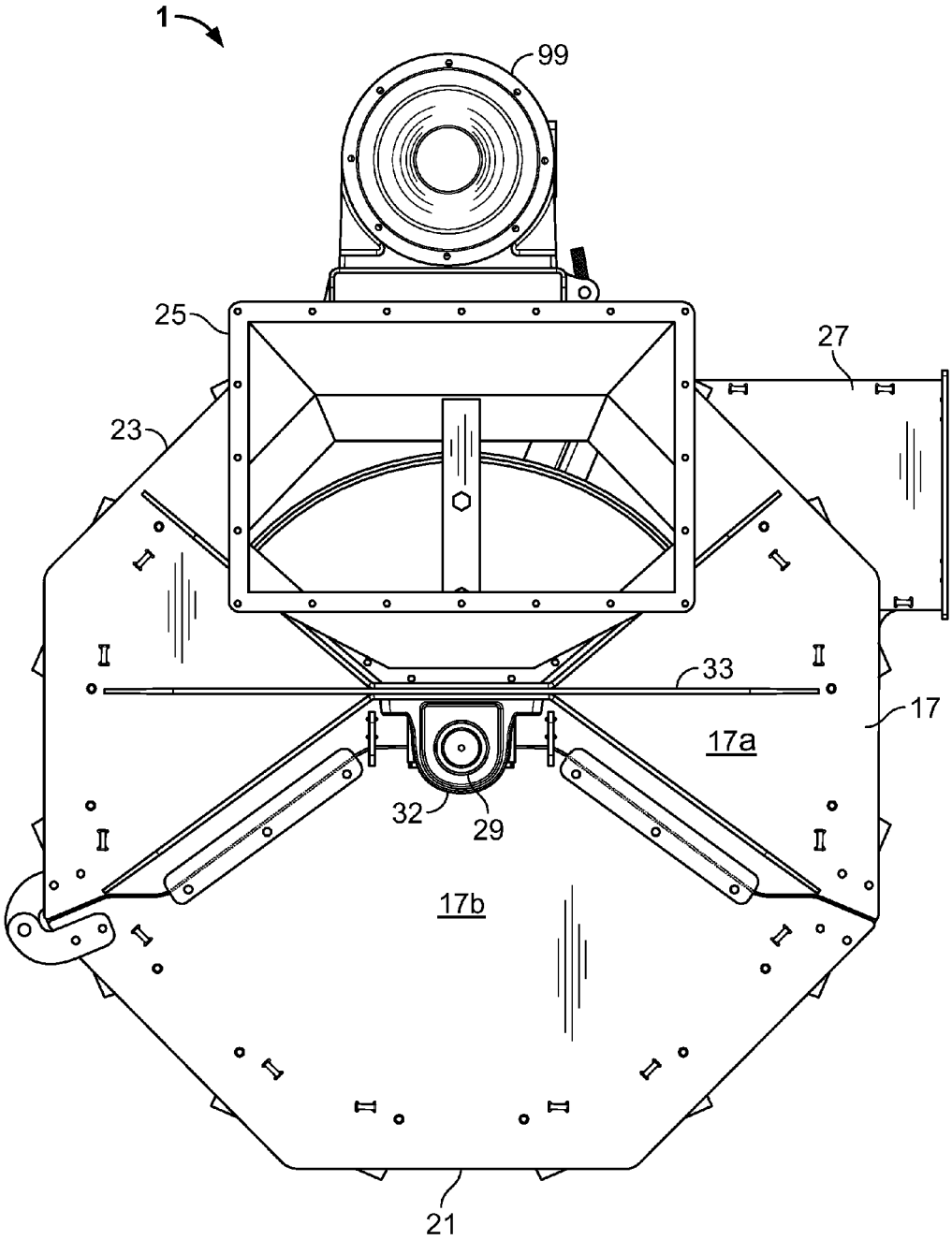
FIG. 4 is top plan view of the grinder.
Figure 5:
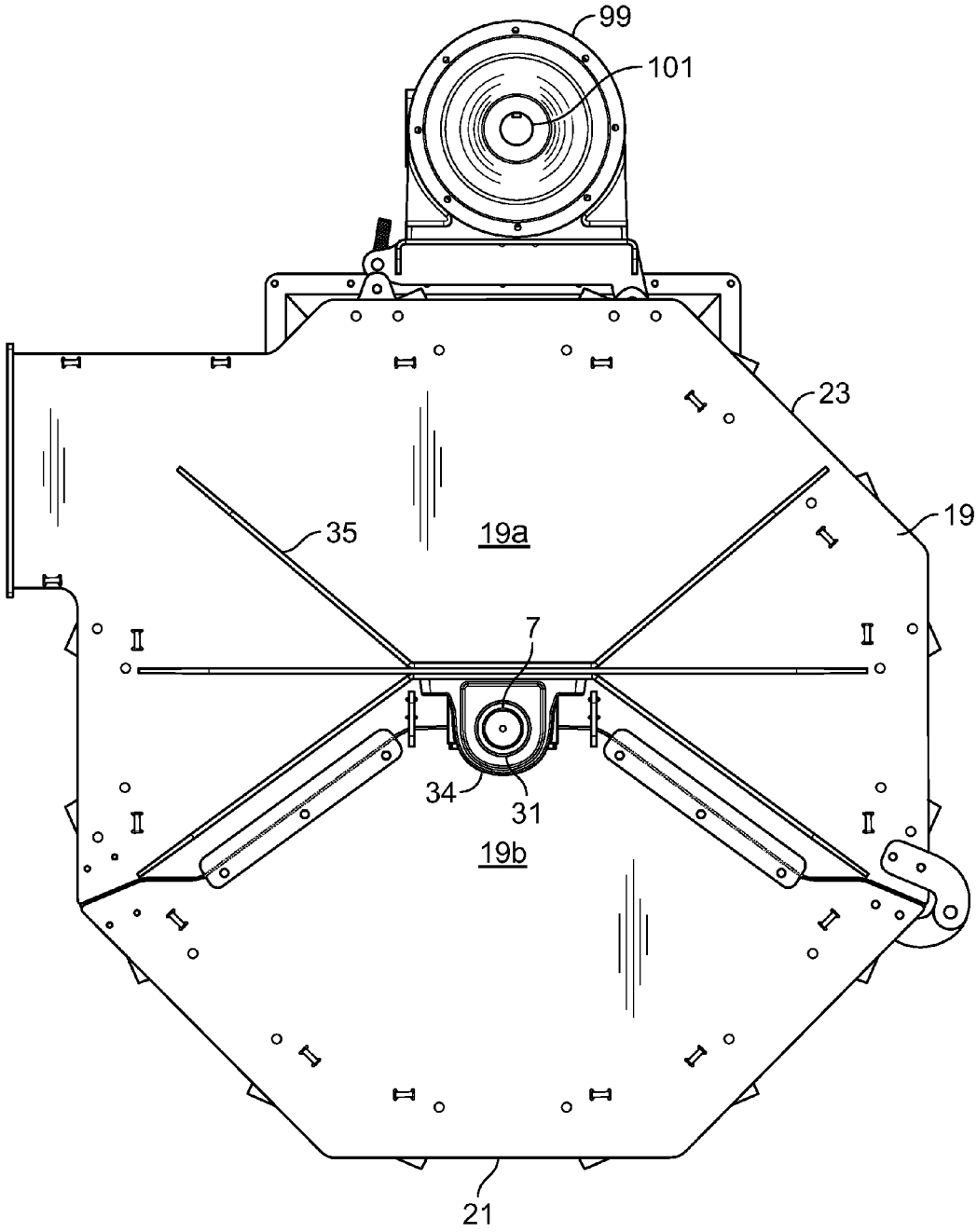
FIG. 5 is a bottom plan view of the grinder.
Figure 7:
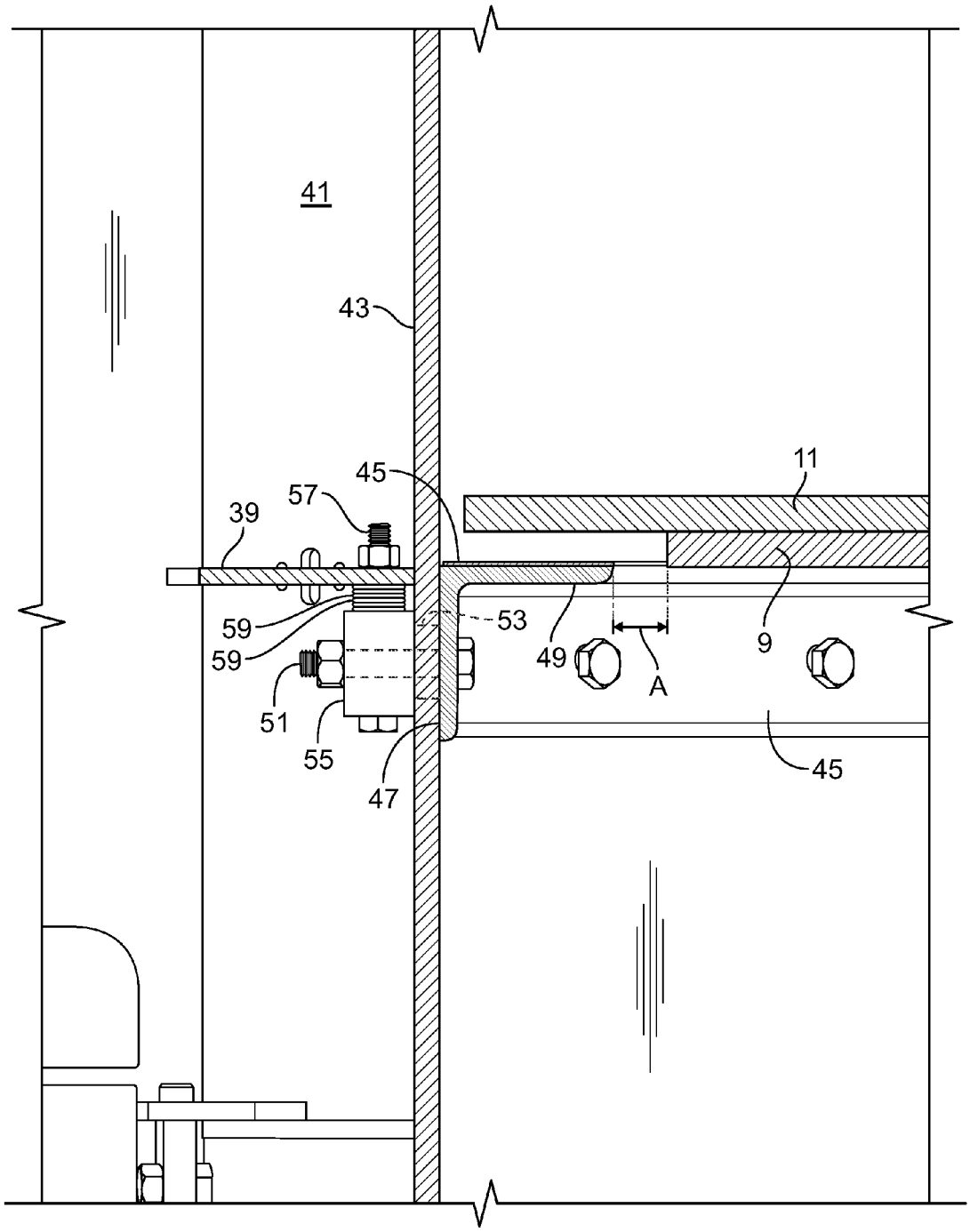
FIG. 7 is an enlarged fragmentary cross-sectional view similar to FIG. 2 showing mounting detail for angle deflectors which form a portion of the grinder.

Each sidewall section 15 includes a sidewall framework 37 comprising a plurality of horizontal ribs 39 extending between vertical ribs 41. A respective replaceable wear plate 43 covers the interior of each sidewall framework 37. Mounted to the interior surface of each wear plate 43 are a plurality of angle deflectors 45, the number of angle deflectors 45 on each sidewall section 15 being equal in number to the number of cutter discs 9. As best seen in FIG. 7, each angle deflector 45 includes a vertical flange 47 positioned in abutment against the interior surface of the respective wear plate 43 and a horizontal flange 49 which extends inwardly from the respective sidewall section 15. The angle deflectors 45 are positioned such that the horizontal flanges 49 are each in general alignment with the outer edge of a respective one of the cutter discs 9 such that the respective hammers 11 move in closely spaced relation to the upper surface of the horizontal flange 49. As shown in FIG. 3, the ends of the angle deflectors 45 are cut at an angle (67.5 degrees) such the horizontal flanges 49 of angle deflectors 45 on adjacent sidewall sections 15 cooperate to form octagonal shelves which extend continuously around the interior of the housing 5.

Figure 6:
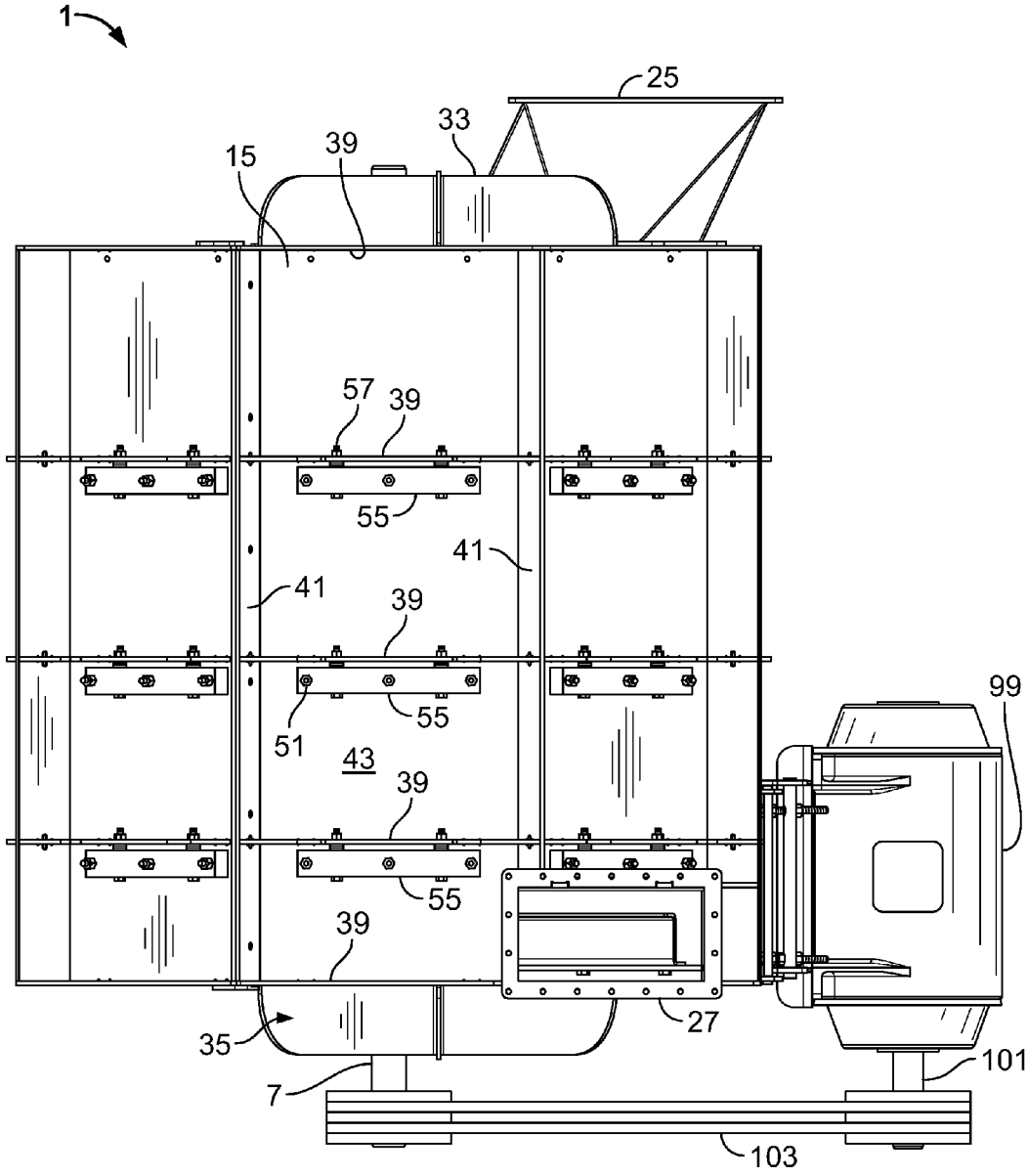
FIG. 6 is a side elevational view of the grinder.

The angle deflectors 45 are mounted to the respective sidewall sections 15 in such a manner that the position of each angle deflector 45 can be fine tuned to insure proper alignment with the respective cutter disc 9. Referring again to FIG. 7, a plurality of bolts 51 (three shown in FIG. 6) extend through holes in the vertical flange 47 of each of the angle deflectors 45, through oblong or oversize openings 53 in the respective wear plate 43, and through horizontal holes in a respective adjustment block 55. The adjustment blocks 55 are each connected to the sidewall framework 37 by vertical bolts 57 which extend through aligned holes in the adjustment block 55 and in a respective one of the horizontal ribs 39 of the respective sidewall framework 37. Shims, washers or spacers 59 can be placed around the vertical bolts 57 between the adjustment block 55 and horizontal rib 39 to adjust the height of the adjustment block 55 and connected angle deflector 45 within the range of the oblong openings 53 in the respective wear plate 43.

A gap A is defined between the outer edge of each cutter disc 9 and the inner edge of the horizontal flanges 49 of the respective angle deflectors 45. The cutter discs 9*a*, 9*b*, and 9*c* are of somewhat increasing diameter from the top to the bottom of the grinder 1 such that the gap A decreases.

Figure 2:
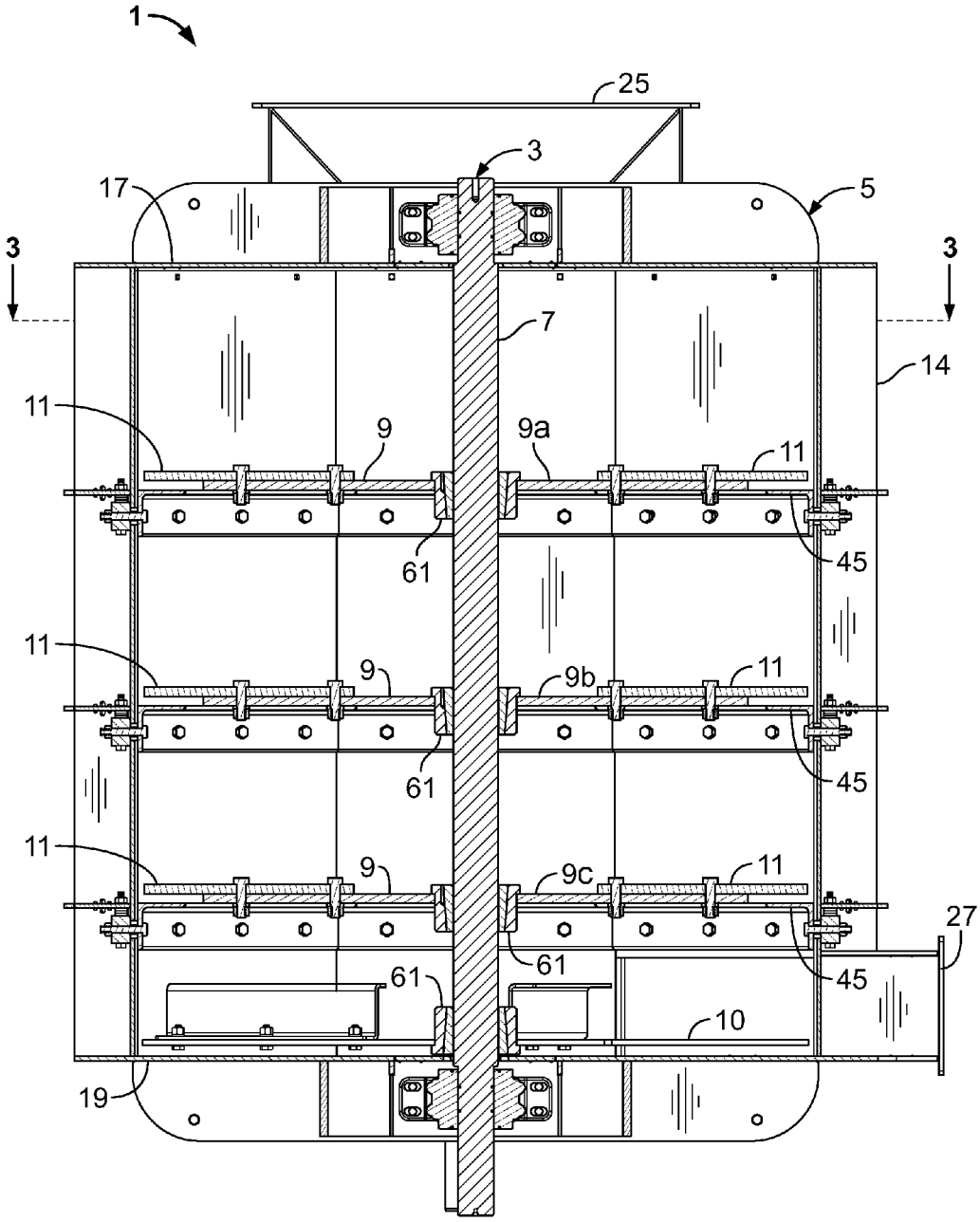
FIG. 2 is a cross sectional view of the grinder taken generally along line 2-2 in FIG. 1.
Figure 8:
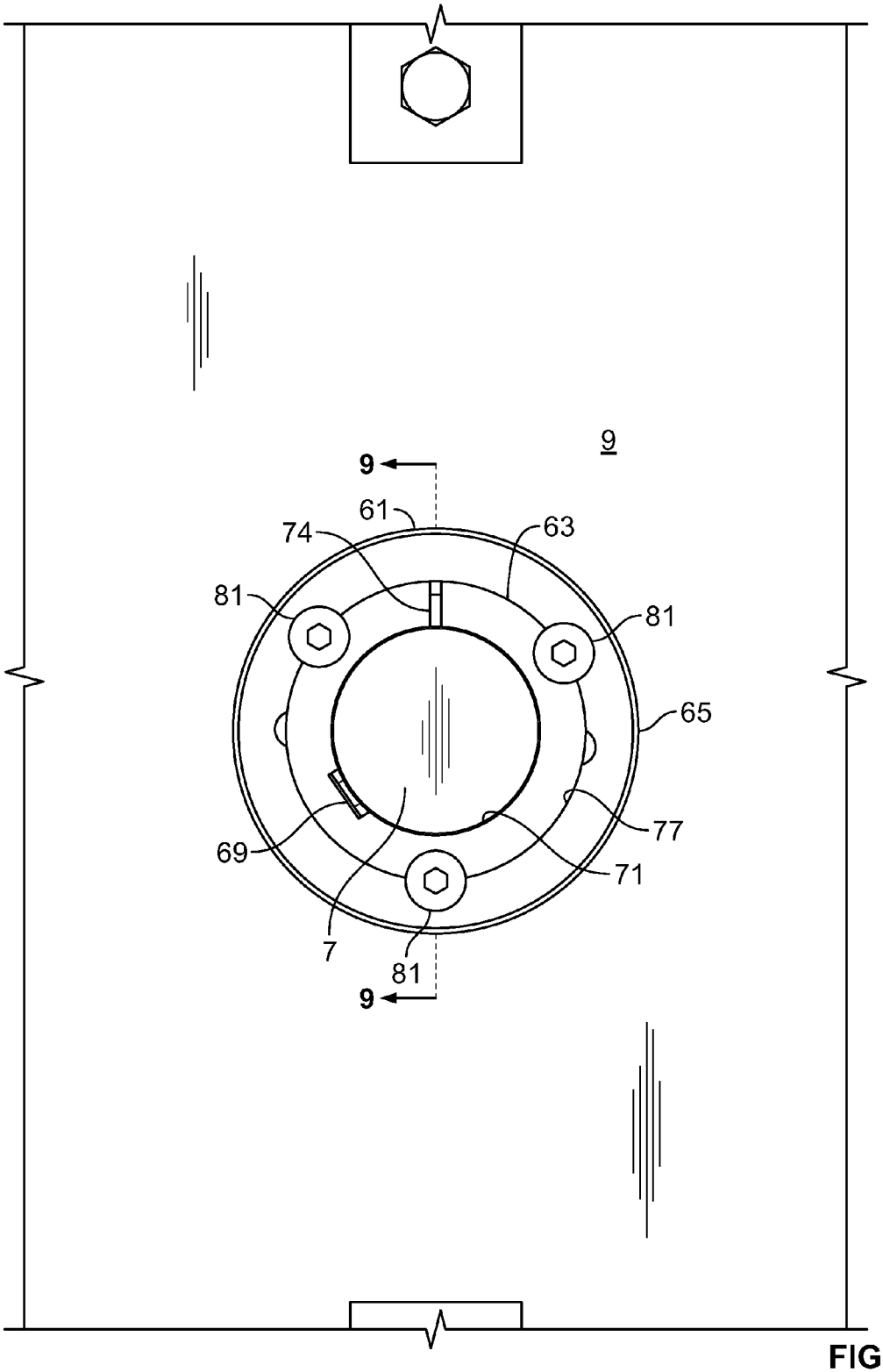
FIG. 8 is an enlarged fragmentary cross-sectional view similar to FIG. 3 showing a taper lock hub used for mounting cutter discs which form a portion of the grinder.
Figure 9:
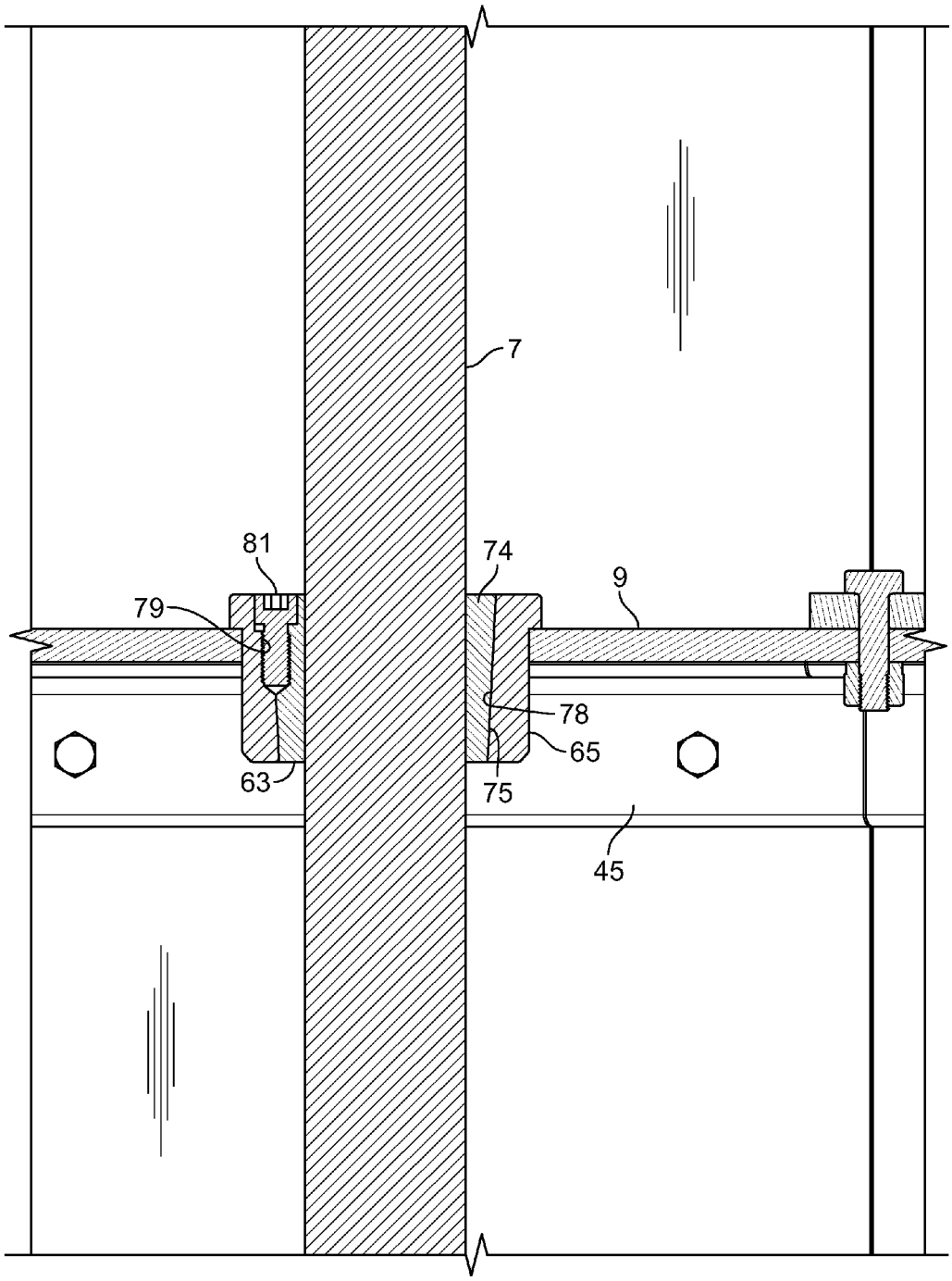
FIG. 9 is a cross-sectional view of the taper lock hub taken generally along line 9-9 in FIG. 8.

Referring to FIG. 2, the positions of the cutter discs 9 and fan disc 10 along the shaft 7 are also adjustable due to the use of taper lock hubs 61 to connect the discs 9 and 10 to the shaft 7. As best seen in FIGS. 8 and 9, each hub 61 includes an inner hub member 63 and an outer hub member 65. The respective cutter disc 9 or fan disc 10 is connected to the outer hub member 65, such as by welding. The shaft 7 includes a respective keyway formed therein for each of the discs 9 and 10. Each keyway 67 receives a key 69. The inner hub member 63 includes a shaft receiver 71 with a keyway 73 sized to receive the key 69. The inner hub member 63 includes a split 74 which allows it to be compressed against the shaft 7 and a tapered outer surface 75. The outer hub member 65 has a central bore 77 sized to receive the inner hub member 63 and an inner surface 78 tapered to match the outer surface 75 thereof. A plurality of fastener receivers 79 are formed between the inner hub member 63 and outer hub member 65 and receive threaded fasteners 81 for drawing the inner hub member 63 into the central bore 77 of the outer hub member 65.

With the fasteners 81 loose and the inner hub member 63 uncompressed, the hub 61 (and attached cutter disc 9 or fan disc 10) can be moved along the shaft 7 and repositioned anywhere within the limits of the length of the respective key 69. Once the cutter disc 9 is in the desired position, the fasteners 79 are tightened, drawing the inner hub member 63 into the tapered central bore 77 of the outer hub member 65 and compressing the inner nub member 63 against the shaft 7 to retain the hub 61 and disc 9 or 10 in position.

Figure 10:
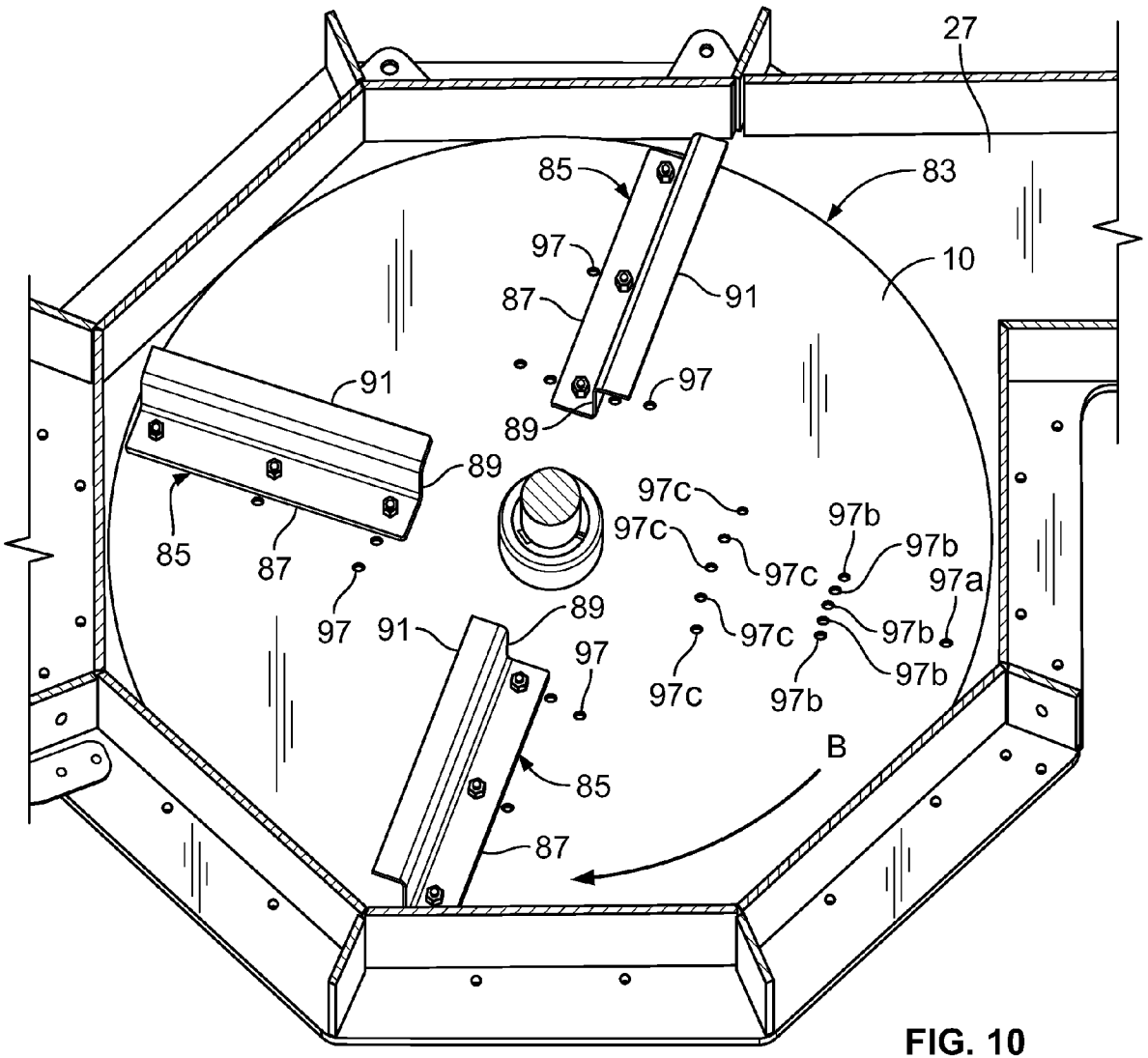
FIG. 10 is a cross-sectional perspective view taken generally along line 10-10 in FIG. 1 and showing a fan assembly which forms a portion of the grinder. One fan blade of the fan assembly has been removed to show detail which would otherwise be obscured by the removed blade.

Referring to FIG. 10, the fan disc 10 forms part of a fan assembly 83 which acts to provide airflow through the grinder 1 and to thereby improve drying of the material, to help move material through the grinder 1, and to expel the ground material through the discharge chute 27. The fan assembly 83 includes a plurality of fan blades 85 which are affixed to the upper surface of the fan disc 10 in a generally radial orientation. Four fan blades 85 are provided in the embodiment depicted with three of the fan blades 85 being shown in FIG. 10. The fourth fan blade 84 has been deleted to show detail which would otherwise be concealed by the deleted fan blade 85. The fan blades 85 each include a bottom flange 87 securable to the fan disc 10, an upwardly extending web 89, and a top flange 91 which extends outwardly from the web 89 in the direction of rotation of the fan disc 10 (designated by arrow B). More specifically, in a preferred embodiment of the fan blade 85, the web 89 extends generally vertically upward from the leading edge of the bottom flange 87 (in the direction of rotation B of the fan disc 10). The top flange 91 then extends generally horizontally outward from the top edge of the web 89, again in the direction of rotation of the fan disc 10. It is foreseen, however, that the angles between the bottom flange 87, web 89 and top flange 91 could be other than right angles.

The bottom flange 87 of each of the fan blade 85 has a plurality of mounting holes formed therein for receiving fasteners 95 (three shown) used to connect the fan blades 85 to the fan disc 10. The fan disc 10 has mounting holes 97 formed therein for receiving the fasteners 95. It is preferred, however, that there be extra mounting holes 97 in the disc 10 to allow the blades 85 to be selectively repositioned to adjust the airflow through the grinder 1. For example, the disc 10 is shown in the drawings as having a single mounting hole 97*a* proximate the outer edge of the disc 10 for the outermost of the fasteners 95. The remaining fasteners 95 are provided with multiple mounting holes 97, arranged in arcuate rows. Five mounting holes 97*b* are shown for the middle fastener 95, and five mounting holes 97*c* are shown for the innermost fastener 95. By selectively pivoting the fan blades 85 about the fastener 95 in the outermost hole 97*a* and selecting different pairs of the mounting holes 97*b* and 97*c*, an operator of the grinder 1 can adjust the angular orientation of the fan blades 85 relative to a true radial orientation and thereby increase or decrease the airflow through the grinder 1 to best suit specific materials to be ground and operating conditions.

The rotor 3 of the grinder 1 is driven by a motor 99 which may be, for example, an electric or hydraulic motor. The motor 99 is mounted to one of the sidewall sections 15 and includes a shaft 101 which is operably connected to a lower portion of the shaft 7 below the bottom wall 19 of the housing 5, such as by a chain and sprocket or belt and sheave system 103.

The grinder 1 may be mounted on any suitable supporting structure, including a trailer (not shown) if it is desired to make the grinder 1 portable. Suitable conveyors may be provided for moving material into the inlet 25 and away from the outlet 27.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A grinder, comprising:

a housing having a plurality of sidewall sections;

a shaft rotatably mounted in the housing between the sidewall sections;

a first cutter disc mounted on the shaft and rotatable therewith;

a plurality of hammers mounted on the first cutter disc and extending outwardly past an outer edge of the first cutter disc;

angle deflectors mounted on the sidewall sections, the angle deflectors extending inwardly from the sidewall section and having an edge in general alignment with the outer edge of the cutter disc and defining a gap therebetween, the hammers each rotating in closely spaced relation to a top surface of the angle deflectors; and, a fan assembly mounted inside the housing below the first cutter disc, the fan assembly comprising:

a fan disc secured to the shaft and rotatable therewith, the fan disc having a direction of rotation; and, one or more fan blades connected to a top surface of the fan disc.

2. The grinder according to claim 1, further comprising:

at least one additional cutter disc connected to the shaft intermediate the first cutter disc and the fan disc, each the additional cutter disc having a plurality of hammers mounted thereon and extending outwardly past an outer edge of the respective additional cutter disc; and, for each sidewall section and for each the additional cutter disc, an angle deflector mounted on the respective sidewall section, each angle deflector having a flange extending inwardly from the sidewall section and having an edge in general alignment with the outer edge of the respective cutter disc and defining a gap therebetween, the hammers each rotating in closely spaced relation to a top surface of the flange.

3. The grinder according to claim 2, wherein the width of the gap decreases for each cutter disc moving down the shaft.

4. The grinder according to claim 1, wherein the one or more fan blades includes a web extending upwardly from the fan disc and a top flange extending outwardly from the web in the direction of rotation of the fan disc.

5. The grinder according to claim 1, wherein each the fan blade is connected to the fan disc by a plurality of fasteners, including a first fastener received through a first hole in the fan disc proximate an outer edge of the fan disc.

6. The grinder according to claim 5, wherein the plurality of fasteners includes a second fastener, and the fan disc has multiple second holes formed therein in which the second fastener can be selectively installed to secure the fan blade to the fan disc while the first fastener is received in the first hole and connects the fan blade to the fan disc.

7. The grinder according to claim 1, wherein the housing comprises eight sidewall sections.

8. The grinder according to claim 1, wherein the housing comprises a door, and the door comprises three sidewall sections which are hingedly connected to the housing, and the housing comprises five sidewall sections.

* * * * *